United States Patent [19]

Knoth et al.

[11] Patent Number: 5,049,039

[45] Date of Patent: Sep. 17, 1991

[54] RADIAL PISTON AND CYLINDER COMPRESSED GAS MOTOR

[75] Inventors: Donald E. Knoth, Dayton; James W. Bradbury, Middletown; Mark A. Nagy, Dayton, all of Ohio

[73] Assignee: Pneumotor, Inc., Dayton, Ohio

[21] Appl. No.: 443,757

[22] Filed: Nov. 30, 1989

Related U.S. Application Data

[63] Continuation-in-part of Ser. No. 212,971, Jun. 29, 1988, abandoned.

[51] Int. Cl.[5] ..... F04B 1/04; F02B 75/22; F01B 1/06

[52] U.S. Cl. ..... 417/273; 123/55 A; 123/55 R; 91/491; 92/68

[58] Field of Search ..... 417/273; 91/491; 92/72, 92/68; 123/55 R, 55 A, 197 AC

[56] References Cited

U.S. PATENT DOCUMENTS

| | | | |
|---|---|---|---|
| 409,457 | 8/1889 | Dennis et al. | 91/180 |
| 424,183 | 3/1890 | Dennis et al. | 91/180 |
| 1,690,144 | 11/1928 | Teasdale | 123/55 A |
| 3,730,054 | 5/1973 | Dickerson | 91/491 |
| 3,800,675 | 4/1974 | Jacobs | 417/273 X |
| 3,977,575 | 8/1976 | Macquire-Cooper | 222/402.24 |
| 3,981,229 | 9/1976 | Breisch et al. . | |
| 4,085,589 | 4/1948 | Breisch et al. . | |
| 4,145,889 | 3/1979 | Breisch et al. . | |
| 4,170,167 | 10/1979 | Breisch et al. . | |

*Primary Examiner*—Leonard E. Smith
*Assistant Examiner*—Peter Korytnyk
*Attorney, Agent, or Firm*—Pearne, Gordon, McCoy & Granger

[57] ABSTRACT

A radial piston and cylinder compressed gas motor is disclosed which is particularly suited for use where economical power sources are required. The motor includes a cylinder block having a plurality of radially extending cylinders open at their outer ends to radially extending passages and having exhaust ports open when associated pistons are adjacent their bottom dead center positions. Such passages extend to a valve system provided on the crank of the motor which functions to supply compressed gas to selected cylinders while connecting other cylinders together so that gas is exhausted from cylinders containing extending pistons to open exhaust ports in other cylinders. This minimizes back pressure to resist motor operation. The crank is formed of two generally cylindrical members and can be produced without eccentric machining or grinding operations. A simple cylindrical head gasket, which is compressed against the periphery of the cylinder block, closes the cylinders and is held in place by a shrink-fitted ring. Peripherally extending inclined slots are formed in the cylinder wall for exhausting gas from the motor into a circular manifold chamber through which the gas is exhausted from the motor. The manifold chamber is provided with enlarged portions adjacent to each exhaust port which reduce exhaust noise. Some embodiments provide motors without master piston rods. Such embodiments provide wrist plates connected to offset piston rods to provide improved starting and running torque.

30 Claims, 10 Drawing Sheets

RADIAL PISTON AND CYLINDER COMPRESSED GAS MOTOR

BACKGROUND OF THE INVENTION

This is a continuation-in-part of my copending application Ser. No. 07/212,971, filed June 29, 1988 now abandoned.

This invention relates generally to noncombustion gas motors and pumps, and more particularly to a novel and improved radial piston and cylinder compressed gas motor and the like.

PRIOR ART

Radial compressed gas motors for starting small internal combustion engines are known. Such devices are illustrated, for example, in U.S. Pat. Nos. 3,981,229; 4,085,589; 4,145,889; and 4,170,167. Such patents describe small, radial piston and cylinder motors which are driven by compressed gas, such as nitrogen, as a power source for starting small internal combustion engines of the type used on lawnmowers, tillers, saws, pumps, and many other power-driven devices. Generally in the past, the small internal combustion engines on such devices have been manually started by a recoil rope pull system. However, in some instances, electric starters have been provided, but such starters require, in most cases, bulky batteries if true portability is required.

In accordance with the above-mentioned patents, a small compressed gas motor is provided which can be used to start the associated internal combustion engine without requiring batteries or other electrical supply connections. The radial motors illustrated in such patents are quite small, and are structured for low-cost manufacture. For example, they provide a molded, nonmetallic piston connected to piston rods with an easily assembled snap-in connection.

It is also known to provide radial cylinder devices in which a master piston rod is not required to stabilize the wrist plate. U.S. Pat. Nos. 867,748; 2,150,548; and 2,209,014 disclose systems in which connecting rods are pivotally connected to a wrist plate. In each case, means are provided to limit the pivotal movement of the connecting rods relative to the wrist plates, and thereby prevent rotation of the wrist plate with the crankshaft without requiring the use of a master rod.

SUMMARY OF THE INVENTION

The present invention provides a novel and improved, radial piston and cylinder structure which can be sufficiently small and low in cost so that it can be used, for example, for the power starting of small internal combustion engines and in substantially any other application in which a noncombustion, nonelectric, small power source is required. The illustrated embodiments of this invention include a small compressed gas-driven motor. However, a number of the important aspects of this invention are also directly applicable to pumps or compressors of a generally similar structure.

There are a number of important aspects to this invention. In accordance with one important aspect, a novel and improved crank structure is provided that can be produced by simple machining operations and which does not require forgings or the like. In the illustrated embodiment, the crank is assembled from two generally cylindrical parts which do not require eccentric machining or grinding operations. Further, the valving for the motor is incorporated into the crank itself. Therefore, separate valve means are not required.

In accordance with another aspect of this invention, a novel and improved cylinder block assembly is provided. The main cylinder block member provides an array of peripherally spaced cylinders which extend generally radially from the central axis of the motor. This member is provided with various passages and ports through which the compressed gas is delivered to each cylinder and exhausted therefrom. An annular head gasket is secured in position by a simple ring which holds the gasket firmly in place and supports the gasket against the loads imposed thereon by the gas under pressure within the various cylinders. The gasket is formed of a material which expands significantly as the motor runs and heats up, so that a good seal is maintained as the temperature of the motor changes during its operation.

In accordance with still another aspect of this invention, an improved exhaust port structure is provided for each cylinder. In the illustrated embodiment, such ports are laterally extending and inclined slots formed in the cylinder side wall. The slots are sized to ensure full exhaust flow and are shaped to substantially reduce exhaust noise without producing objectionable wear on the seal of the associated piston as it moves back and forth across the exhaust port.

Further, where very low exhaust noise levels are required, the exhaust ports exhaust through an impulse damping exhaust ring which further reduces the exhaust noise of the unit.

In accordance with still another aspect of this invention, a novel and improved valved exhaust system is provided. In one embodiment, a system interconnects the cylinders in which pistons are extending with the cylinders in which the exhaust ports are open. This prevents undesirable back pressure from being developed by the extending pistons, and results in drastically improved power output of a given sized motor supplied with a source of gas under a given pressure. Further, this drastically reduces the required supply pressure to operate the motor.

This exhaust system also tends to limit overspeeding of the unit under no-load conditions.

In other embodiments, an exhaust system exhausts the cylinders having extending pistons through valves directly to atmosphere after such cylinders are initially exhausted through ports in the cylinder wall. This provides an immediate and complete drop of the pressure in the cylinder followed by an effective exhaust as the piston extends, thereby preventing any build-up of pressure as the pistons extend.

In accordance with still another aspect of this invention, a novel and improved radial cylinder motor or pump is provided in which a master piston rod is not required. In such device, the piston rods are pivotally connected to the wrist plate for limited pivotal movement arranged to prevent rotation of the wrist plate with its crankshaft journal.

The connecting rods are offset so that their pivotal connection with the wrist plate is offset from a line between the wrist plate axis and the associated piston axis. The forces applied to the wrist plate by the piston rods produce a force couple tending to cause rotation of the wrist plate in only one direction. Such rotation, however, is progressively prevented by the limits on the pivotal movement of the piston rods. The offset construction is selected to increase the moment arm of the force applied by the pistons, and therefore the starting and running torque of the motor.

In one illustrated embodiment, the offset piston rods are provided in a mechanism in which the cylinders extend radially with respect to the crankshaft axis. In another embodiment, the cylinders are angled with respect to the crankshaft axis in the same directions as the piston rod offset.

All of these various aspects of this invention cooperate to provide reduced cost, increased reliability, and improved efficiency.

These and other aspects of this invention are illustrated in the accompanying drawings, and are more fully described in the following specification.

DETAILED DESCRIPTION OF THE DRAWINGS

Figure 1:
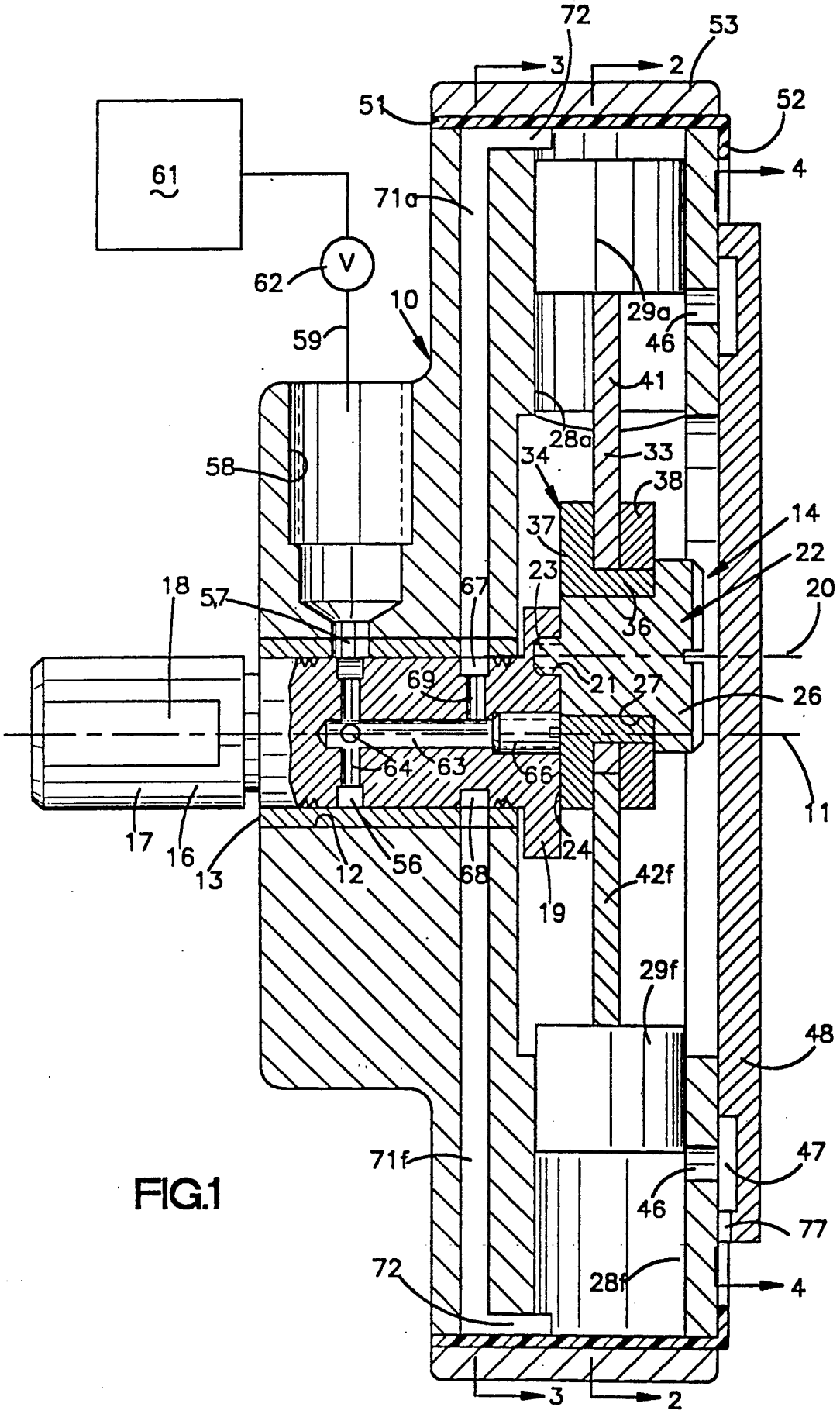
FIG. 1 is a centerline cross section of a compressed gas motor incorporating the present invention.
Figure 2:
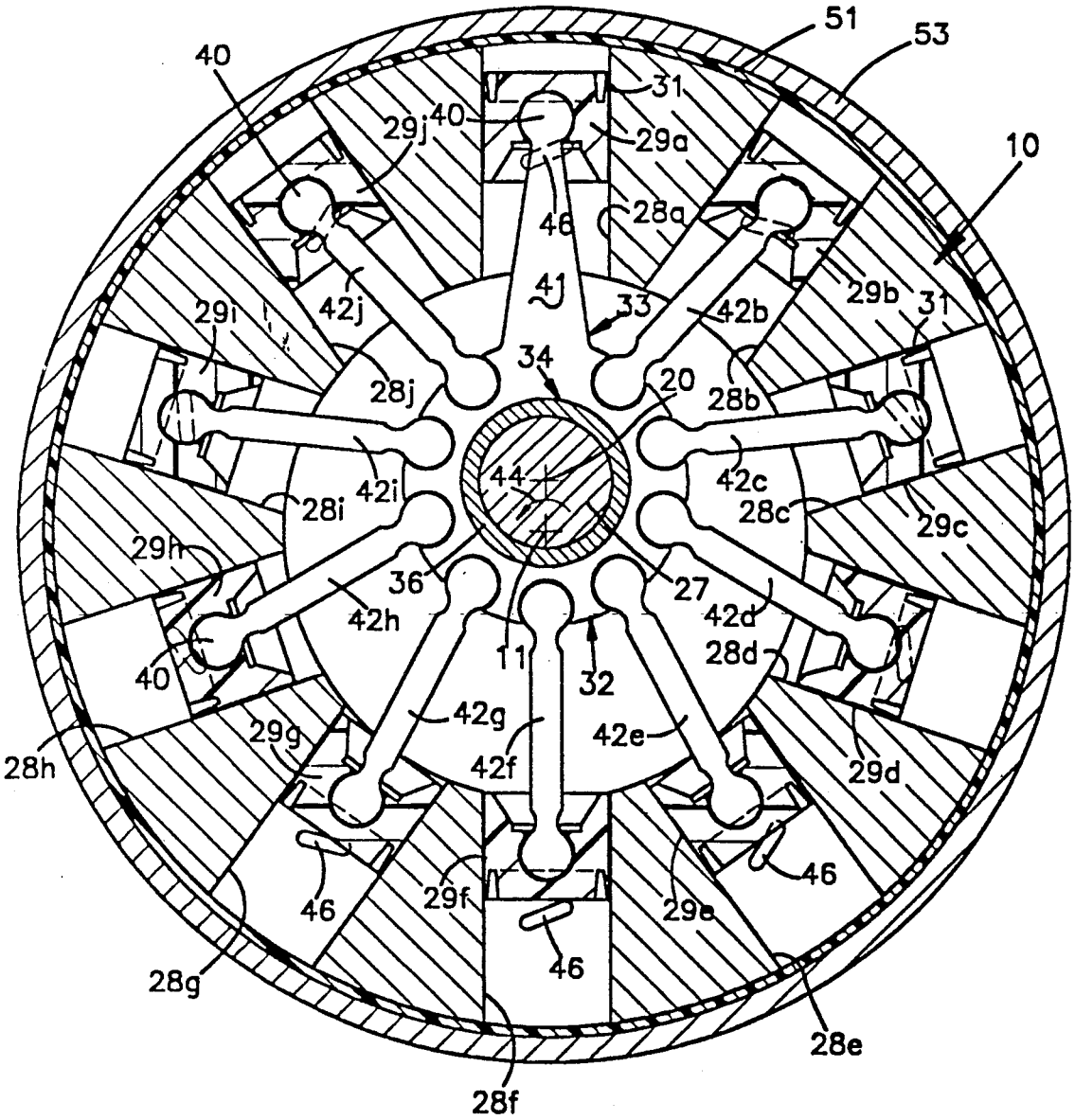
FIG. 2 is a cross section, taken generally along line 2—2 of FIG. 1, illustrating the general structure of the pistons and connecting rod system.

FIGS. 1 and 2 illustrate the overall structure of one preferred embodiment of this invention. Such embodiment includes a cylinder block 10 which is generally symmetrical around a central axis 11. The cylinder block 10 provides a crankshaft bore 12 extending along the axis 11, having a sleeve bearing 13 mounted therein. A crankshaft assembly 14 includes a main crankshaft member 16 extending through and journaled within the sleeve bearing 13. The main crankshaft member provides the inlet and exhaust valving system, as discussed below, and provides an outer end which extends beyond the cylinder block 10 and providing a structure for connecting the motor to a load. Such outer end is preferably provided with a flat 18 to facilitate such connection.

The inner end of the main crankshaft member 16 is provided with a radially extending flange 19 having an eccentric threaded bore 21 having an eccentric axis 20. A crank screw 22 is mounted on the main crankshaft member 16 by a threaded end 23 threaded into the threaded bore 21. Such crank screw 22 provides an end wall 24 which engages the side of the radial flange 19 and provides a substantial area of support for the screw 22. The outer end of the screw is formed with an enlarged head 26 on the side of a cylindrical stem portion 27 remote from the flange 19. Therefore, the flange 19 and the screw provide an eccentric crank portion of the crankshaft assembly which is coaxial with the eccentric axis.

The cylinder block in the illustrated embodiment is provided with ten cylinder bores **28*a* through 28*j* which extend radially from the central axis 11** and are evenly spaced around the periphery of the cylinder block. It should be understood that although the illustrated embodiment is a ten-cylinder motor, the present invention can be embodied in motors or compressors having a greater or lesser number of cylinders.

Positioned in each cylinder 28 is an associated piston **29*a* through 29*j*. These pistons are preferably nonmetallic plastic molded pistons having a lip seal 31**, as disclosed and claimed in U.S. Pat. No. 3,981,229, supra.

The pistons 29 are connected to the crankshaft by a connecting rod system 32, including a master connecting rod 33 which is journaled at its inner end on a bearing ring 34, which is in turn journaled on the stem portion 27 of the crank screw 22. As best illustrated in FIG. 1, the bearing ring 34 provides an axially extending cylindrical portion 36 and a radially extending flange 37 which extends outwardly along one side of the master rod 33. An annular bearing ring 38 extends along the opposite side of the master rod and cooperates with the flange 37 to embrace the opposite side of the master rod adjacent to the crank screw 22.

Referring again to FIG. 2, the master rod 33 provides a connecting rod portion 41 which extends out to and is connected to the piston **29*a*. Separate connecting rods 42*b* through 42*j* provide a connection between the associated pistons 29*b* through 29*j* and the master rod 33. These piston rods 42*b* through 42*j* are provided with enlarged, generally cylindrical end portions 40 which snap into mating recesses in the associated pistons 29 and fit into mating recesses in the master rod 33. The manner in which the connecting rods 42** are connected to their associated pistons and to the master rod is described in U.S. Pat. No. 3,981,229, supra, and reference to that patent may be made for a more complete description of this connecting rod system.

Figure 3:
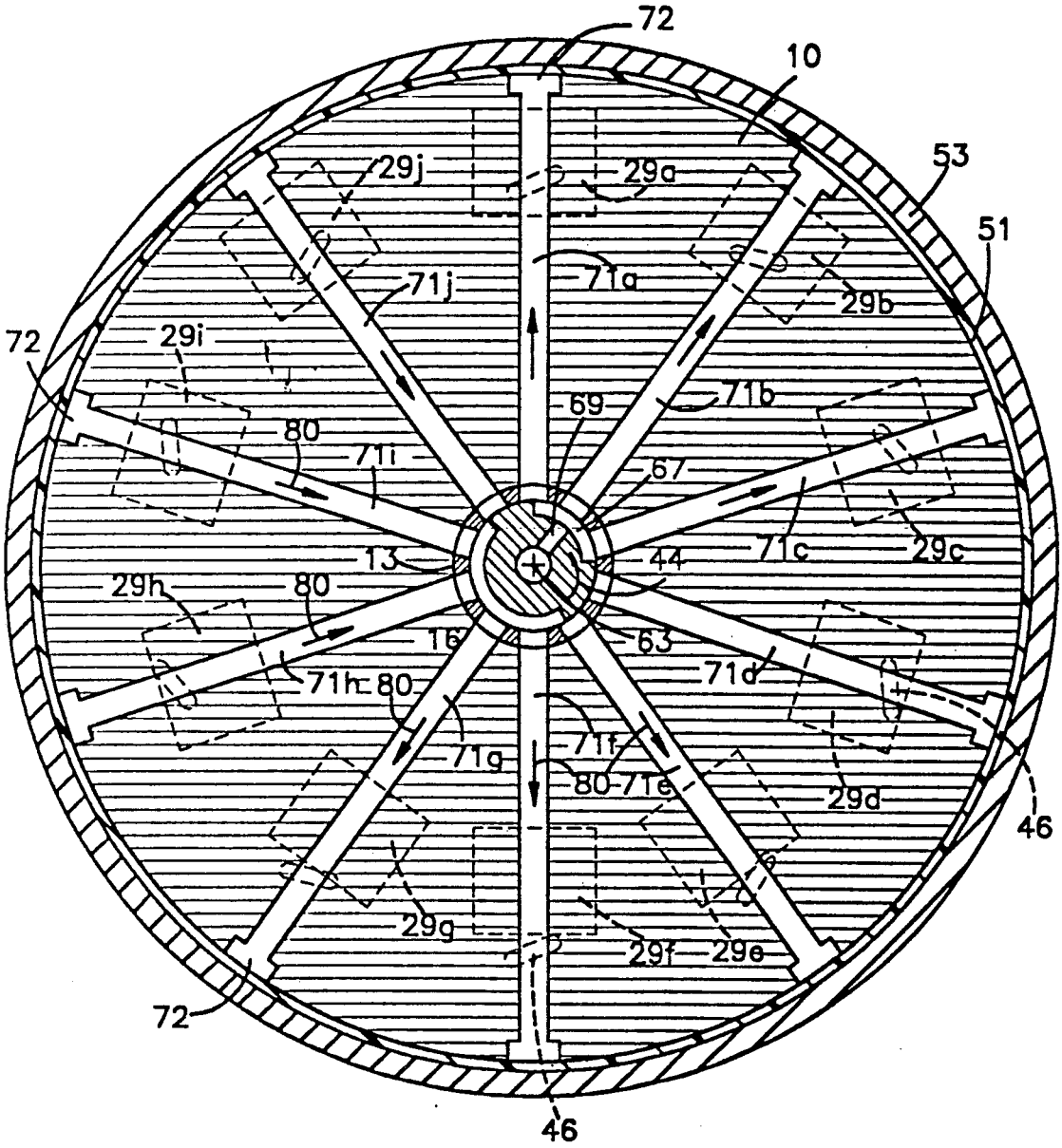
FIG. 3 is a cross section, taken generally along line 3—3 of FIG. 1, illustrating the valving function and structure.

As the crankshaft assembly 14 rotates, the eccentric axis 20 and stem portion 27 move around the central axis 11. This causes the various pistons 29 to reciprocate radially within their associated cylinder bores 28 between a top dead center position and a bottom dead center position. As best illustrated in FIG. 2, the piston **29*a* is in its top dead center position and the piston 29*f* is in its bottom dead center position. If it is assumed that the crank is rotating in an anticlockwise direction, as illustrated in FIG. 3 and indicated by the arrow 44, about the central axis 11, the pistons 29*b* through 29*e* are moving radially inward toward their bottom dead center position and the pistons 29*g* through 29*j*** are extending toward the top dead center position.

Each of the cylinder bores 28*a* through 28*j* is provided with an exhaust port 46 in the form of an inclined, peripherally extending slot 46 which opens through the side wall of the cylinder block to a circular groove 47 in a manifold plate 48. The exhaust ports are covered by the associated pistons 29 except when the associated pistons 29 are substantially adjacent to their bottom dead center position. The exhaust operation of the motor is discussed in greater detail below.

The outer ends of the cylinders 28*a* through 28*j* are closed by a generally cylindrical head gasket 51. The head gasket 51 provides a positioning flange 52 which engages the side of the cylinder block and facilitates its proper positioning during its installation on the cylinder block. The head gasket 51 is tightly pressed against the outer surface of the cylinder block by a clamping ring 53. Normally, the clamping ring 53 and the cylinder block are formed of the same metal, e.g., aluminum, and the clamping ring is heated and expanded prior to installation, and therefore shrinks into tight clamping engagement with the outer side of the head gasket 51.

The head gasket 51 is preferably formed of a material which has a higher coefficient of thermal expansion than the material forming the cylinder head and the clamping ring, so that as the motor warms up during operation a good seal is provided between the outer surface of the cylinder head and the head gasket. One such material which has been found to be satisfactory is marketed by the DuPont Company of Wilmington, Del. under the trade name HYTREL. Since such material has a substantially higher coefficient of thermal expansion than aluminum, a good seal is provided even if the unit warms up in operation.

As best illustrated in FIGS. 1 and 3, the main crankshaft member 16 provides the valving function for supplying compressed gas to the various cylinders, and for providing an exhaust path to prevent back pressure from being built up within cylinders having pistons extending therein. The main crankshaft member 16 is provided with an annular groove 56 extending completely around the periphery thereof in communication with a high pressure inlet port 57. The inlet port 57 is open to a threaded passage 58 formed in the cylinder block 10 for connection to a pressure line 59 from a pressure source schematically illustrated at 61. Normally, a valve 62 is provided in the pressure line so that gas under pressure is supplied to the motor only when motor operation is required.

A central passage 63 is formed in the main crankshaft member 16 which is open to the groove 56 through a plurality of circumferentially spaced radial ports 64, and is closed at its inner end by a plug 66.

The main crankshaft member 16 is also provided with two peripherally spaced external grooves 67 and 68. The groove 67 is an inlet groove connected to the central passage 63 by a radial passage 69, and the groove 68 is an exhaust groove which is isolated from the inlet groove 67, as best illustrated in FIG. 3. Each cylinder 28*a* through 28*j* is connected at its outer end through a groove 72 formed in the cylinder block 10 to an associated radial passage 71*a* through 71*j*, also formed in the cylinder block. These radial passages extend inwardly through the sleeve bearing 13 and are selectively opened to the inlet groove 67 and the exhaust groove 68 as the crankshaft assembly 14 rotates.

FIG. 3 illustrates the operation of the valve system for supplying compressed gas to the cylinders and exhausting the gas therefrom. In such figure, the pistons 29*a* through 29*j* are illustrated in phantom along with their respective exhaust ports 46.

When the valve 62 (illustrated in FIG. 1) is opened, compressed gas is delivered from the source of pressure to the inlet port 57 and through the passages 64 to the central passage 63. This compressed gas is therefore delivered through the radial passage 69 to the inlet groove 67. In the position of FIG. 3, the inlet groove 67 communicates with the radial passages 71*a*, 71*b*, and 71*c*. Therefore, gas under pressure is delivered to the cylinders containing the pistons 29*a*, 29*b*, and 29*c*. This produces a force on these pistons urging them radially inward, and operates through the associated piston rods 41 and 42 to cause crank rotation in an anticlockwise direction, as indicated by the arrow 44. In the position of FIG. 3, the piston 29*a* is at its top dead center position, while the pistons 29*b* and 29*c* are past their top dead center positions. Such pistons 29*a*, 29*b*, and 29*c* are also in a position in which they isolate the associated cylinders from their associated exhaust ports 46.

In the illustrated position, however, the piston 29*d* is isolated from the source of pressure and also isolated from the exhaust port. Therefore, the gas within the cylinder associated with the piston 29*d* expands, resulting in additional power delivered from the compressed gas.

In the illustrated position, the pistons 29*e*, 29*f*, and 29*g* have all moved a sufficient distance toward their bottom dead center position to uncover the associated exhaust port 46 and the compressed gas is exhausted through such associated ports.

The exhaust groove 68 extends a sufficient distance around the periphery of the main crank member so that all of the radial passages 71*e*, 71*f*, 71*g*, 71*h*, and 71*i* are connected together. Consequently, as the pistons 29*h* and 29*i* extend toward their top dead center position, the gas contained within the associated cylinders exhausts through the associated passages 71*h* and 71*i* to the exhaust groove 68 and along the radial passages 71*e*, 71*f*, and 71*g* to their exhaust ports 46, as indicated by the arrows 80. Consequently, back pressure does not develop as the pistons extend and substantially complete breathing of the motor is provided.

In this illustrated embodiment, the extending piston 29*j* is virtually isolated from the exhaust groove 68 so that a slight amount of buildup of pressure can occur in the cylinder containing the piston 29*j* as such piston continues to extend. However, such piston is approaching a top dead center position so the back pressure buildup is not excessive. Still further, such a buildup of pressure reduces the amount of compressed gas which must be admitted when the cylinder of the piston 29*j* is first opened to the inlet groove 67.

With this system, in which the cylinders containing the extending pistons are exhausted back through the radial passages associated therewith to cylinders containing open exhaust ports, a substantial increase in the power output of the motor for a given supply pressure and motor speed is achieved.

Figure 5:
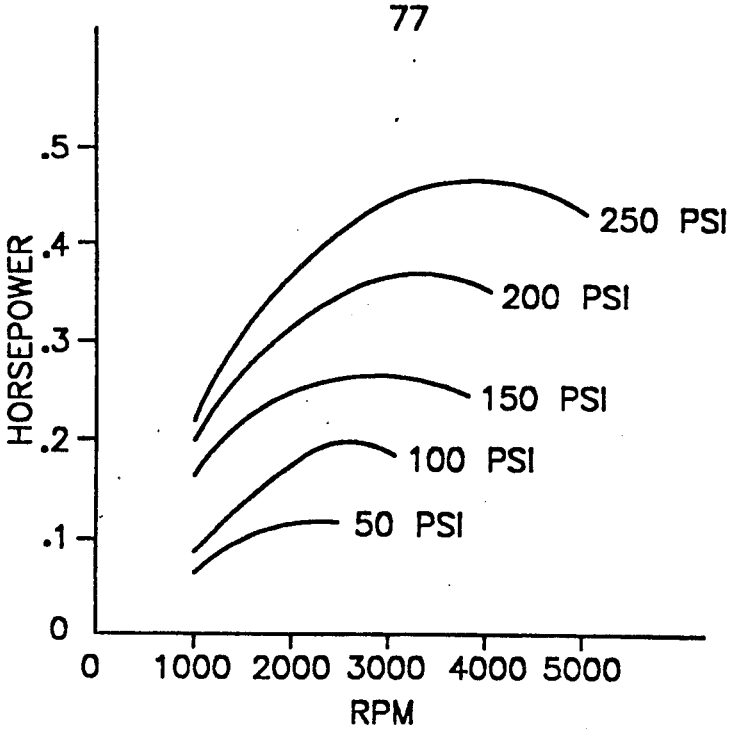
FIG. 5 is a set of curves illustrating the power output versus speed obtained with a prototype of this invention operating at various supply pressures.

It has been established by actual tests run on a prototype motor substantially as illustrated in the accompanying drawings that substantial amounts of power can be obtained at relatively lower pressures. For example, as illustrated in FIG. 5, such prototype, which was about 3 inches in diameter, produced one-tenth of horsepower at about 2000 rpm when supplied with compressed gas at about 80 psi. However, a similar motor which did not provide for interconnecting the extending cylinders so as to prevent the buildup of back pressure required a supply pressure of compressed gas in excess of 300 psi before the motor even commenced to rotate. As illustrated in FIG. 5, the prototype motor is capable of producing substantial power outputs at relatively low pressures. For example, at a supply pressure of 250 psi, a motor operating at 4000 rpm produced slightly more than 0.45 horsepower.

Those skilled in the art will recognize that as the crank rotates, the piston 29*j* moves to its top dead center position and is brought into communication with the compressed gas supplied through the inlet groove 67, and the exhaust groove 68 progressively provides connections between the extending cylinders and the cylinders which are being exhausted due to the fact that the piston uncovers the associated exhaust ports.

Figure 4:
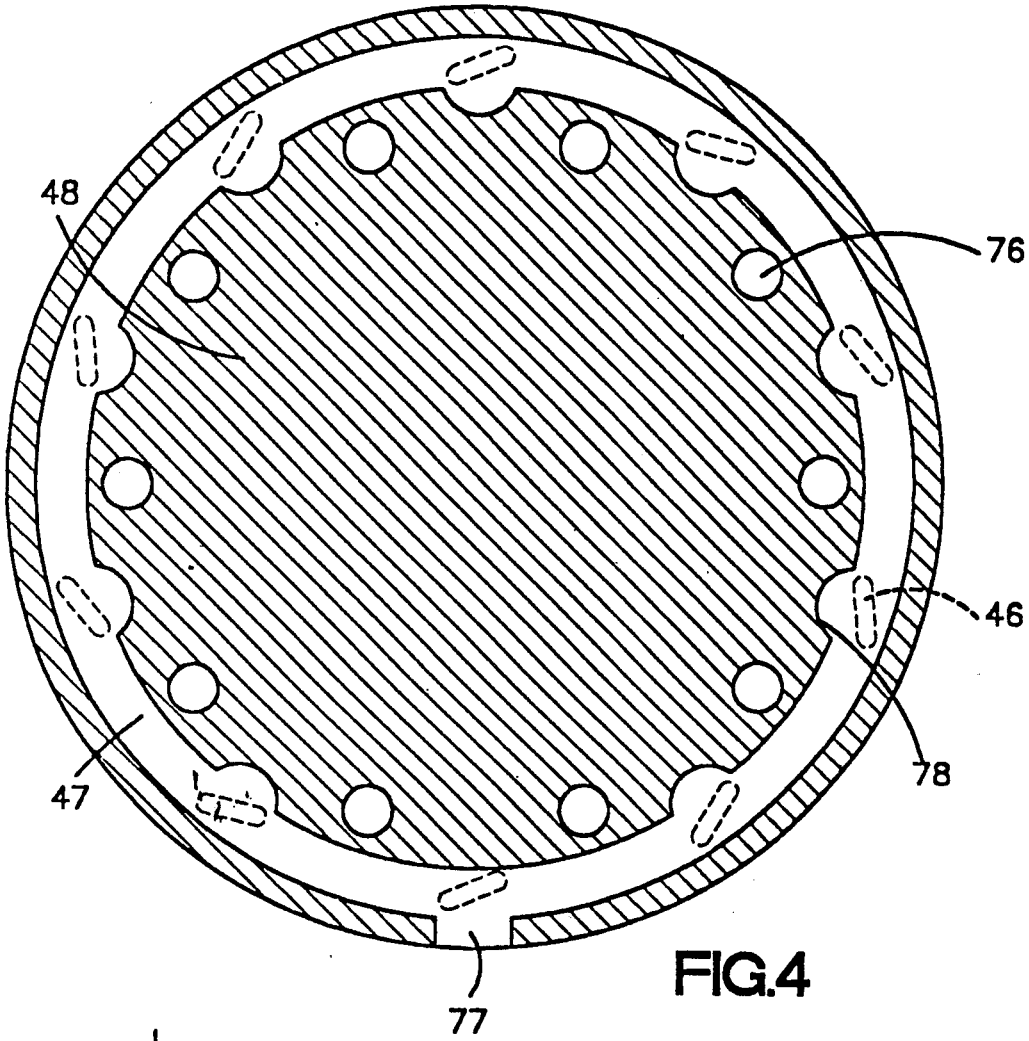
FIG. 4 is a cross section, taken generally along line 4—4 of FIG. 1, illustrating the exhaust manifold plate.

FIG. 4 illustrates a preferred form of manifold plate which interconnects all of the exhaust ports 46. Such plate is bolted by bolts (not illustrated) extending through openings 76 to one side of the cylinder block 10 so that all of the exhaust ports 46 are open to the circular groove 47. Such groove is vented to the environment through a radial groove 77 so that air exhausting through all of the exhaust ports 46 passes along the groove to the radial groove 77 and therethrough to the environment.

The structure illustrated in FIG. 4 greatly reduces the exhaust noise of the motor and is desired for use where quiet motor operation is desired or required. As best illustrated in FIG. 4, the groove is provided with a semi-cylindrical enlarged portion 78 adjacent to each exhaust port. These enlarged portions 78 provide noise reducing chambers adjacent to the exhaust ports so that the sharp impulse of air flowing through each exhaust port is cushioned. This results in a substantial reduction in the noise of the exhaust.

Also, the exhaust ports are formed as inclined peripherally extending grooves or slots so that as the pistons move inwardly toward their bottom dead center position, a relatively small exhaust area is opened initially and the exhaust area progressively increases. By providing the exhaust ports as inclined elongated slots, a substantial exhaust area is provided within a single port. This also reduces exhaust noise when compared to a multiplicity of small ports. Further, since substantial exhaust port area is provided, improved exhaust flow is achieved.

It is recognized that the exhaust system does provide a relatively lengthy passage for the exhaust gas. However, this is desirable in that it reduces the tendency for the motor to overspeed under no-load conditions by, in effect, throttling the exhaust to some extent when excessive motor speeds might be encountered. Although it is desirable to provide the manifold plate with a restrictive exhaust system so as to reduce the exhaust noise of the motor and to prevent the motor from overspeeding under no-load conditions, in some instances where such requirements are not present, greater power outputs can be obtained by directly venting the exhaust ports to the environment. The manifold plate 48 also functions to isolate the interior of the motor from the environment and prevents the collection of dirt or debris within the motor, and its use is normally preferred.

The present invention provides improved power output and efficiency while providing a low-cost, reliable structure. For example, the two-piece crankshaft is constructed with two component parts each of which is substantially symmetrical about an axis. Therefore, eccentric grinding and machining operations are not required. Further, the inlet and exhaust valving operations are provided by the crankshaft without requiring separate valving means. Additionally, the cylinder block assembly includes only three elements: the main cylinder block, a single ring gasket, and a shrink-fitted ring to hold the ring gasket in place. Therefore, a low-cost, reliable cylinder block assembly is provided. Still further, a simple structure is provided in the exhaust manifold plate which combines the functions of reducing exhaust noise, limiting the no-load speed, and preventing dirt or contaminants from entering the motor. Further, a simple connecting rod system is provided that is easily assembled and which is reliable in operation.

Figure 6:
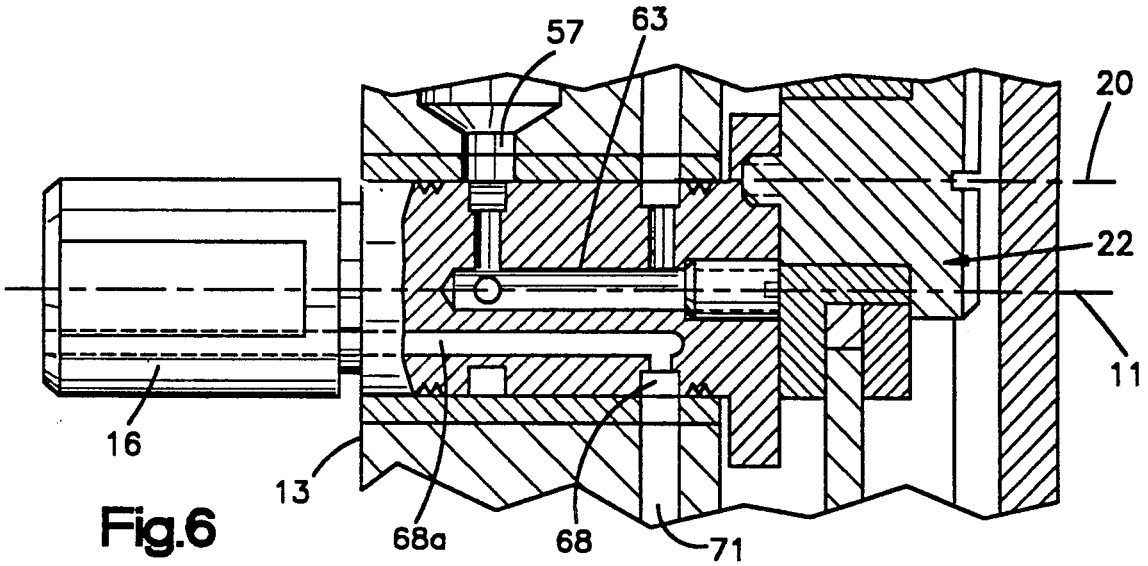
FIG. 6 is a modified version of the motor of FIGS. 1 through 5, in which the cylinders containing the extended pistons are also exhausted through the crankshaft to atmosphere.

FIG. 6 illustrates a modified form of the motor illustrated in FIGS. 1 through 5. In this modified version, the exhaust groove 68 is directly connected to atmosphere through an axial passage 68*a* in the crankshaft member 16. With this modified version, the exhaust gas from cylinders containing extending pistons flows through the radial passages 71 communicating with the exhaust groove and directly therefrom to atmosphere. This version shortens the exhaust path for cylinders containing extending pistons, and therefore provides less restricted exhaust flow.

FIGS. 7 through 10 illustrate another preferred embodiment of a compressed gas motor in accordance with the present invention. In this embodiment, separate cylinders 101 are bolted in place between a cylinder cover plate 102 and a valve housing plate 103. The cylinders 101 are preferably formed with a hexagonal exterior shape and are bolted against mounting faces 100 formed in the housing plate 103. By providing separate but identical cylinders, cost savings can be realized in the manufacture of the cylinder assembly. The cylinder assembly also includes a bearing housing 104 through which bolts 106 extend to hold the assembly, consisting of the cylinders 101, the cover plate 102, the valve housing 103 and the bearing housing 104 together.

Figure 10:
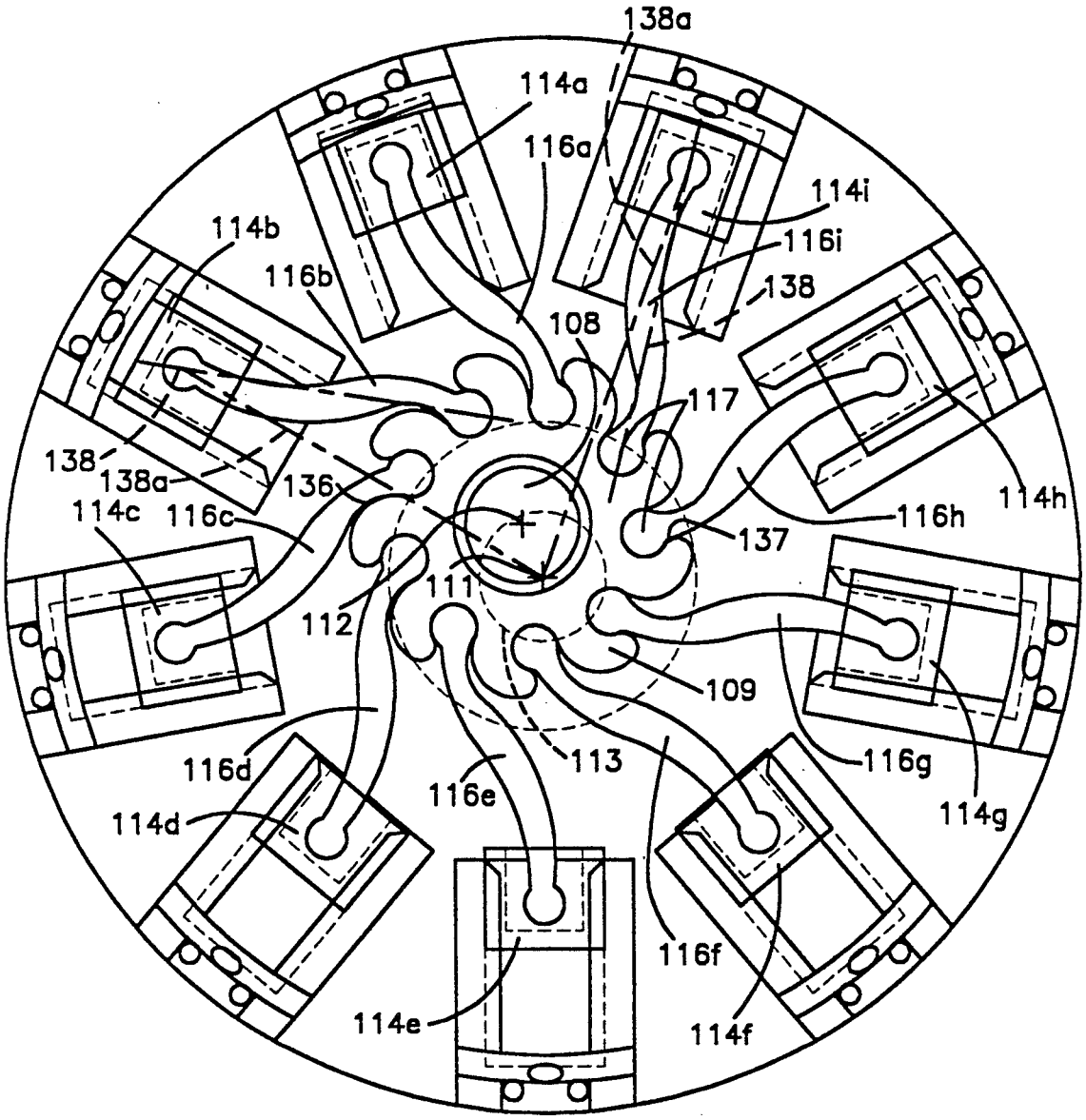
FIG. 10 is a schematic cross section of an offset piston rod wrist plate assembly taken generally along line 10—10 of FIG. 7.

Journaled in the bearing housing is a crankshaft 107. The crankshaft provides at its inner end an offset journal 108 on which a wrist plate 109 is journaled. The wrist plate 109, having a construction generally as illustrated in FIG. 10, orbits around the central axis 111, with the axis 112 of the wrist plate moving along a locus illustrated by the dotted circle 113.

Positioned in each of the cylinders 101 is a piston 114 which is reciprocal within the associated cylinder between a top dead center position of the piston 114*a* and a bottom dead center position of the piston 114*e*. Connecting rods 116*a* through 116*i* are provided to connect the associated of the pistons 114 to the wrist plate 109. These piston rods are provided with a snap-in connection, with the associated piston of the type described above in connection with the first embodiment, and are provided with a pivotal type connection 117, with the wrist plate 109. As discussed in detail below, the structure of the pivotal connection 117 between the wrist plate and the pistons limits the degree of pivotal movement of the piston rods relative to the wrist plate and functions to prevent rotation of the wrist plate with the crankshaft journal 108. In fact, the orientation of the wrist plate remains substantially constant as the wrist plate orbits around the central axis 111. The manner in which this pivotal connection 117 prevents rotation of the wrist plate is described in detail below. In the case of a compressed gas motor, the connecting rods operate to cause rotation of the crankshaft when the pistons move between both top dead positions and their bottom dead center positions. Also, as illustrated in FIG. 10, the piston rods are provided with an offset which is discussed below.

Mounted on the crankshaft 107 is a face valve 118 which is connected for rotation with the crankshaft 107. The face valve 118 provides an arcuate inlet opening 119 and an arcuate exhaust groove 121. A supply of compressed gas is connected to an inlet passage 122 formed in the bearing housing 104 by a suitable fitting (not illustrated).

The valve housing 103 is provided with a radially extending passage 123 associated with each of the cylinders 101 and connected at its outer end 124 to the outer end of the associated cylinder 101. The outer portions of the passages 123 are formed as open grooves in the face of the mounting portions 100 of the valve housing 103 which are closed by the outer surface of the associated cylinders 101. The inner end of the radially extending grooves 123 join with a radial groove portion 127 which is open to the face of the face valve 118. The opposite side of the face valve 118 is exposed to an annular groove 128 connected to the inlet passage 122 so that a supply of compressed gas is provided in an annular zone around the axis and is open to the adjacent side of the face valve 118.

As the face valve 118 rotates, the inlet opening in the face valve 118 progressively connects the inlet passage 122 to the cylinders 101. The timing is arranged so that as the pistons move inwardly from the top dead center position, compressed gas is admitted to the associated cylinder to create a power stroke urging the pistons in an inward direction toward the bottom dead center position.

In order to exhaust the cylinders containing extending pistons, the valve housing 103 is provided with exhaust passages 132 which are in alignment with the exhaust channel 121 in the face valve, and as the face valve rotates the exhaust channel 121 interconnects the radial passages 123 and the exhaust passages 132 to provide for a direct exhaust connection out through the ports 131 for the cylinders containing extending pistons. The housing plate 103 is formed with radially extending recesses 130 between the mounting portions to connect the passages 132 and the ports 131. This structure provides a substantially direct and unrestricted exhaust path so that the exhaust flow from the cylinders containing extending pistons is substantially unrestricted. This effectively prevents back pressure from building up.

In this embodiment, however, the cylinder walls are again provided with angled exhaust ports 133 which are uncovered as the pistons 114 approach the bottom dead center position to provide a direct exhaust to atmosphere. By combining these two exhaust systems, the efficiency of the exhaust system is maximized. The exhaust ports provide an immediate and effective release of the compressed gas while the piston is in the bottom dead center position and, as the pistons extend recovering the exhaust ports 133, the secondary exhaust system, including the face valve and the exhaust passages 132, ensure that back pressure does not build up in the cylinders containing extending pistons. It has been found that with this exhaust system, improved power output is achieved with a given size motor operating with a given supply pressure.

Figure 8:
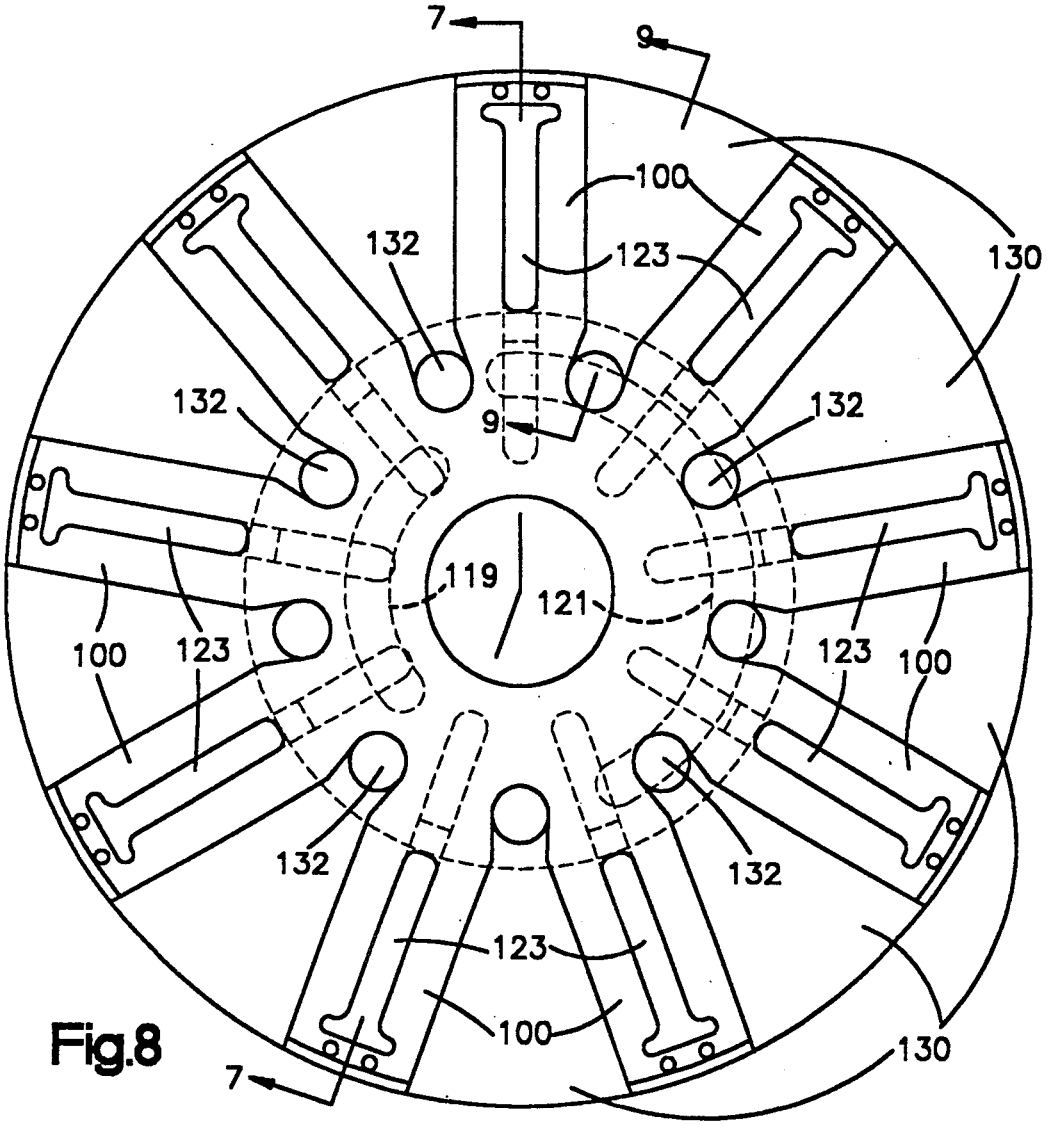
FIG. 8 is a cross section, taken generally along line 8—8 of FIG. 7.
Figure 7:
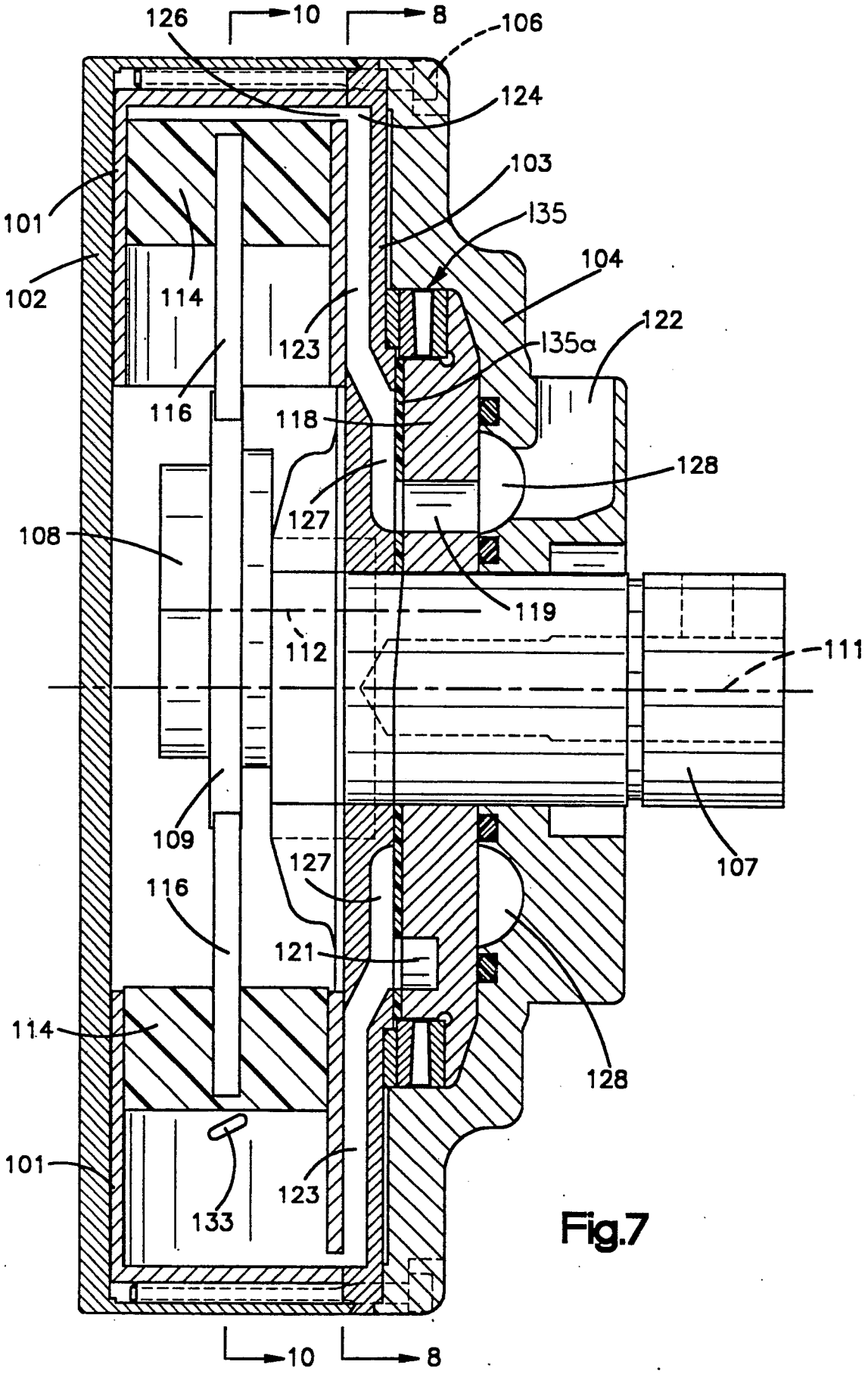
FIG. 7 is a cross section of another embodiment of a compressed gas motor providing a rotary face valve on the crankshaft to control the admission of compressed gas and the exhaust thereof.
Figure 9:
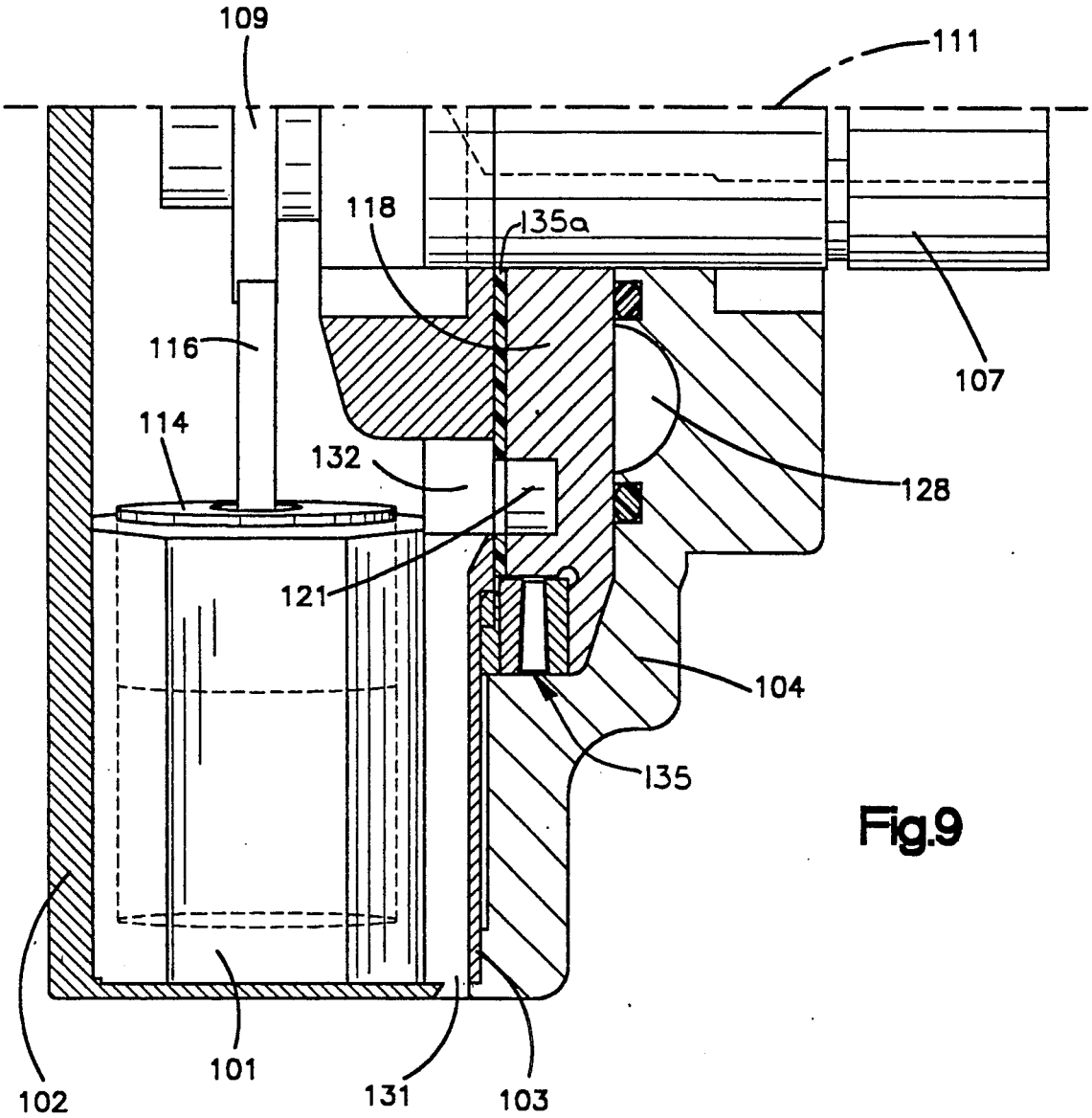
FIG. 9 is a fragmentary section taken along line 9—9 of FIG. 8, illustrating the exhaust passage structure.

In order to reduce frictional forces at the face valve 118, such valve is provided with a thrust bearing at 135 and a low friction seal 135*a*. The face valve is preferably arranged so that the supply pressure of compressed gas is admitted simultaneously to about three of the cylinders moving from the top dead center position toward the bottom dead center position, as best illustrated in FIG. 8, and the exhaust groove 131 connects about five cylinders as they move from the bottom dead center position to the top dead center position. It is not necessary, however, to arrange the face valve to include an exhaust connection for the cylinders at the bottom dead center position because the exhaust ports 133 are uncovered at this point in the cycle of the machine.

Referring to FIG. 10, the pivot connection 117 between the wrist plate 109 permits pivotal movement between two extreme positions, with one extreme position illustrated by the piston rod 116*c*. In such position, contact exists along an interface 136 to prevent rotation of the wrist plate 109 in a clockwise direction beyond such position. At the same time, the piston rods 116*g* and 116*h* are at the other extreme or limit of pivotal movement with respect to the wrist plate 109, and engagement at an interface 137 prevents movement of the wrist plate 109 in an anticlockwise direction. Therefore, the piston rods 116*c*, 116*g*, and 116*h* cooperate to completely stabilize the wrist plate and hold it against rotation with its journal. As the crankshaft rotates in a clockwise direction as viewed in FIG. 10, the connecting rods 116*b* and 116*f* thereafter cooperate to stabilize the wrist plate. As the crankshaft rotates, opposed pairs of piston rods operate in a sequence in which at least one pair of connecting rods provides the required stabilizing action at all times. With this structure, the wrist plate 109 is held with a fixed orientation as the crankshaft rotates.

As best illustrated in FIG. 10, the connecting rods 116 are formed with an offset so that a first line of action represented by the dotted lines 138 extending through the two pivot connections at the ends of each of the connecting rods is angled with respect to a second line of action 138*a* extending between the pivots connecting each connecting rod 116 to its associated piston 114 and the central axis 111. Also, the first lines of action 138 are offset from both the pivot axis 112 of the wrist plate and the central axis 111 in the same direction at all times.

In a comparable device in which the piston rods are not offset, the piston rods associated with pistons at their top dead center and bottom dead center positions are aligned with the central axis and the lines of action of such piston rods move back and forth through the central axis. In such prior structures, the moment arm of the power stroke pistons is limited. However, with the illustrated offset connecting rods, the power stroke pistons have a much larger effective moment arm and provide greater torque. Further, since the system is fully symmetrical, a uniform torque is produced. The offset piston rods combined with the wrist plate provide improved starting and running torque.

It should be noted that in the power stroke, the piston rods are in compression, and also during a substantial portion of the exhaust stroke. Consequently, the forces on the wrist plate 109 tend to maintain a clockwise bias on the wrist plate. Therefore, forced reversals do not tend to occur and the wrist plate is completely stabilized. Further, the length of the interface 136, which prevents such clockwise rotation, is substantially longer than the interface 137, since greater forces must be absorbed along said interface 136.

Figure 11:
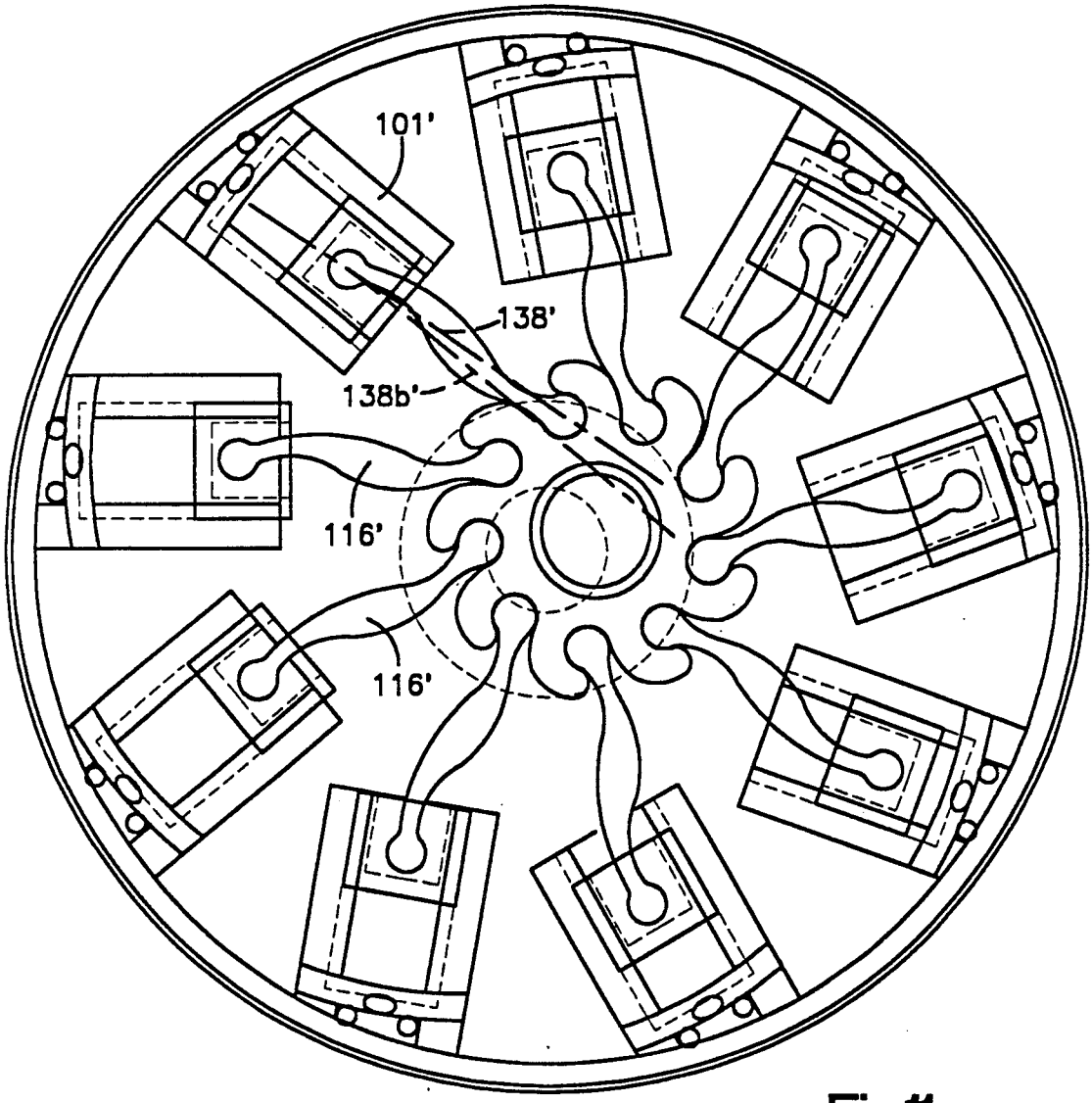
FIG. 11 is a schematic cross section similar to FIG. 10, but illustrating an embodiment in which the piston rods are offset and the cylinders are inclined with respect to the central axis of the unit in the same direction as the piston rod offset.

FIG. 11 illustrates an embodiment in which the cylinders 101' are inclined so that the line of action 138' of the offset piston rods 116' is substantially in line with the axis or line of action **138*b*** of the associated cylinders when the pistons are in their power stroke. With this structure, the side loads on the piston are substantially diminished, with a corresponding reduction in the friction of the pistons moving along the cylinder walls.

Figure 12:
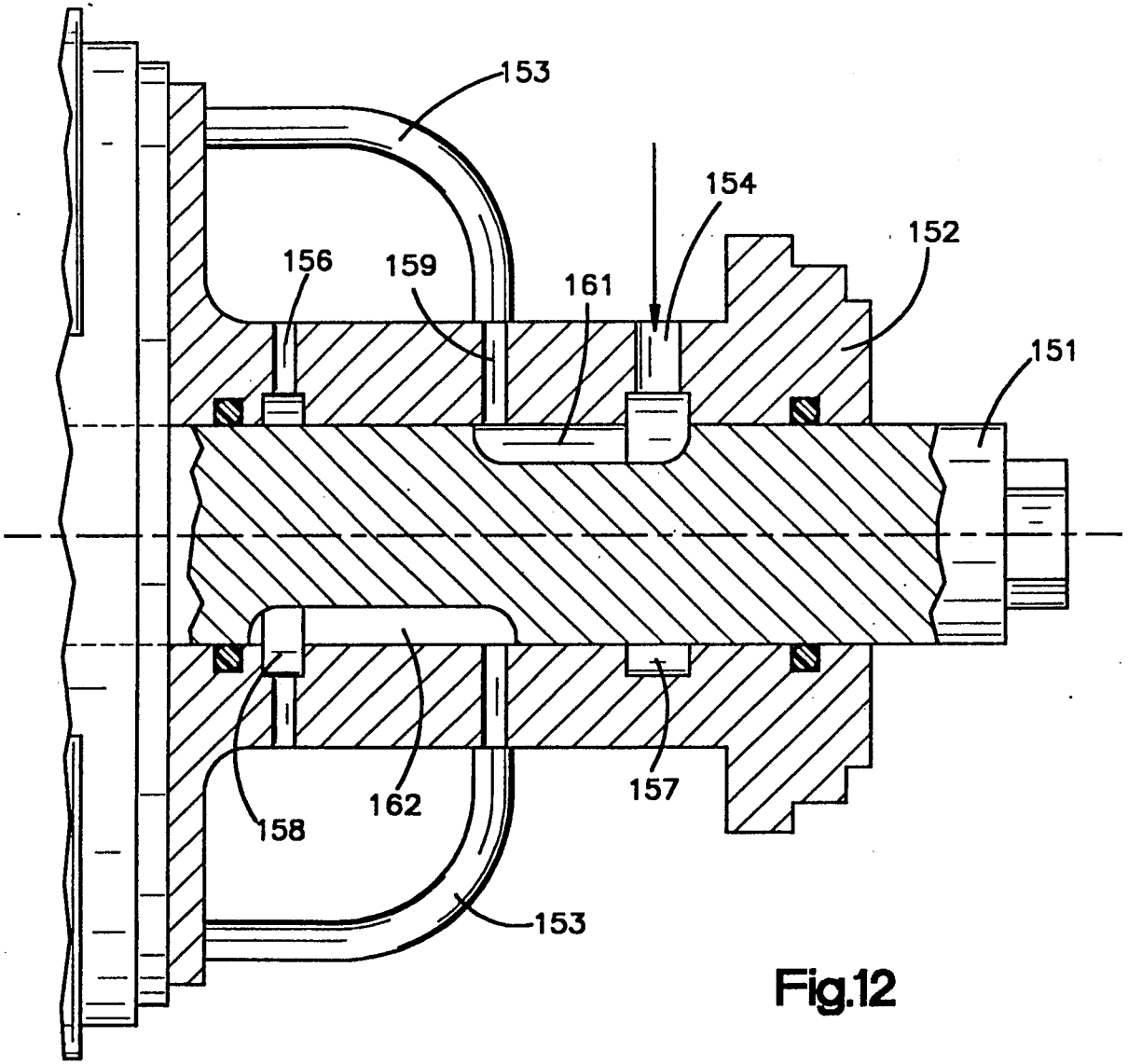
FIG. 12 illustrates another embodiment in which the valving function is provided in the crankshaft.

FIG. 12 illustrates a shaft valve which may be substituted for the valve system of the first embodiment of FIG. 1. In this embodiment, the crankshaft 151 is journaled in a valve housing 152 and is provided at its inner end with a crank journal (not illustrated) connected to an offset wrist plate connecting rod system of the type illustrated in FIGS. 10 and 11. In this instance, however, curved, generally L-shaped tubes 153 connect the valve housing to the outer ends of the associated cylinders (not illustrated). The valve housing provides an inlet port 154 through which compressed gas is admitted, and a plurality of exhaust ports 156. The inlet port connects with an annular groove 157 and the exhaust ports connect with an annular groove 158. The inner ends of the tubes 153 connect through passages 159 to the surface through which the crankshaft extends. Preferably, the passages 159 are located axially approximately midway between the two grooves 157 and 158.

The crankshaft 151 is provided with an axially extending groove 161 along one side extending from the groove 157 at one end to the location of the passages 159 at the other end. Another groove 162 in the crankshaft 151 extends at its inner end from the groove 158 to its outer end in communication with the passages 159. These grooves 161 and 162 function to provide the intake and exhaust control of the motor.

The groove 161 is positioned and sized so that compressed gas entering the port 154 is supplied through the groove 161 to the tubes 153 connecting to the cylinders in which a power stroke is occurring. At the same time, the exhaust groove 162 connects the cylinders having extending pistons therein to the groove 158 from which the exhaust gases are directly exhausted to atmosphere through the passages 156. With this valve system, substantially unrestricted flow occurs through the valve, and the valve can be manufactured accurately at low cost, since the grooves 161 and 162 are external of the crankshaft.

With these various embodiments, improved non-combustion, compressed gas motors are provided which are capable of producing substantial power with relatively small structures running at reasonable pressures. In the embodiments in which a wrist plate is utilized without a master rod, more uniform torque characteristics are obtained, and it has been found that the motors will commence to operate at lower pressures.

It should be understood that the wrist plate design and some of the other features of the present invention are applicable also to compressors and the like.

Although the preferred embodiments of this invention have been shown and described, it should be understood that various modifications and rearrangements of the parts may be resorted to without departing from the scope of the invention as disclosed and claimed herein.

What is claimed is:

1. A compressed gas motor comprising a cylinder block having cylinders therein having extremities, pistons reciprocable in said cylinders between top dead center positions adjacent to said extremities and bottom dead center positions spaced from said extremities, valved means connected to each cylinder at said extremities thereof, exhaust ports in each cylinder open only when the pistons therein are adjacent to their bottom dead center positions, said valved means operating to supply compressed gas to said extremities of said cylinders having pistons therein commencing to move toward said bottom dead center positions, said valved means also connecting at least some of said cylinders having pistons therein moving toward their top dead center position to cylinders having open exhaust ports.

2. A compressed gas motor as set forth in claim 1, wherein said pistons are connected to a crankshaft journaled for rotation in said cylinder block around an axis, reciprocation of said pistons causing rotation of said crankshaft, and said valved means are operated in timed relationship to the rotation of said crankshaft by said crankshaft.

3. A compressed gas motor as set forth in claim 2, wherein said valved means includes a rotary valve formed in said crankshaft.

4. A compressed gas motor as set forth in claim 3, wherein said cylinders are peripherally spaced around said axis and said pistons move toward and away from said axis.

5. A compressed gas motor as set forth in claim 3, wherein said valved means includes a first peripherally extending groove in said crankshaft connected to a source of fluid under pressure, and a second peripherally extending groove in said crankshaft isolated from said first groove, said second groove being operable to interconnect cylinders for exhausting gas therefrom.

6. A compressed gas motor as set forth in claim 5, wherein said cylinder block provides passages extending from said crankshaft to each cylinder at the end thereof remote from said crankshaft, said first and second peripheral grooves being selectively connected to said passages as said crankshaft rotates.

7. A radial compressed gas motor comprising a cylinder assembly providing a plurality of cylinders extending radially from an axis, a crank journaled for rotation around said axis, a piston reciprocable between a bottom dead center position and top dead center position in each cylinder, connecting means connecting each piston to said crank, each cylinder providing exhaust port means covered by the associated piston except when said associated piston is substantially at its bottom dead center position, a source of gas under pressure, valve means rotatable with said crank, said valve means connecting said source to cylinders having pistons therein substantially adjacent to said top dead center positions, said valve means also connecting cylinders having pistons therein substantially adjacent to said bottom dead center position to cylinders having pistons therein moving towards said top dead center position whereby gas within said cylinders containing extending pistons is exhausted through said exhaust ports of cylinders having ports uncovered by said pistons therein.

8. A radial motor as set forth in claim 7, wherein said valve means includes grooves formed in the periphery of said crank operable to connect said source to cylinders having pistons therein substantially adjacent to said top dead center positions and also operable to connect cylinders containing pistons extending therein to cylinders having ports uncovered by said pistons therein.

9. A radial motor as set forth in claim 7, wherein said exhaust ports open to a circular exhaust manifold passage through which gas is exhausted from said motor.

10. A radial motor as set forth in claim 7, wherein said exhaust port means includes an inclined peripherally extending slot formed in the wall of each cylinder.

11. A radial motor as set forth in claim 8, wherein said cylinders extend to extremities spaced from said crank, said cylinder assembly including radial passages connecting said extremities of said cylinders to said grooves through which gas under pressure is supplied to said cylinders and also through which gas is exhausted from said cylinders.

12. A radial motor as set forth in claim 9, wherein said manifold passage provides enlarged chamber portions adjacent to said exhaust ports to reduce the exhaust noise of said motor.

13. A compressed gas motor comprising a cylinder block providing a plurality of cylinders aligned with a crank axis, a crankshaft journaled for rotation around said crank axis, each cylinder containing an associated piston connected to said crankshaft reciprocable therein between a top dead center position and a bottom dead center position when said crankshaft rotates, each cylinder providing an exhaust port covered by said associated piston when said associated piston is spaced from said bottom dead center position and uncovered and opened by said associated piston when said associated piston is at and adjacent to its bottom dead center position, inlet and exhaust valve means operable in timed relation to the rotation of said crankshaft, and passage means connecting said valve means to each of said cylinders on the side of said associated piston remote from said crankshaft, said valve means operating to admit gas under pressure to each cylinder through said passage means when said associated pistons therein are adjacent to their top dead center position and commencing to move toward their bottom dead center positions, said valve means also connecting together through said passage means cylinders in which said associated pistons are moving toward their top dead center positions and cylinders in which said associated pistons therein are adjacent to their bottom dead center positions, gas within cylinders in which said associated pistons are moving toward their top dead center positions flowing through said passage means and valve means to cylinders in which exhaust ports are opened and through which gas exhausts from said motor.

14. A radial cylinder compressed gas device comprising a cylinder block assembly providing a central axis and a cylindrical peripheral surface, said cylinder block assembly providing a plurality of peripherally spaced cylinders extending radially from said central axis open at outer ends to said peripheral surface, a non-metallic cylindrical head gasket encircling said peripheral surface closing the outer ends of said cylinders, a metallic ring encircling said head gasket tightly pressing said head gasket into fluidtight engagement with said peripheral surface, a crankshaft journaled in said cylinder block assembly for rotation about said central axis, and pistons reciprocable in said cylinders connected to said crankshaft, said head gasket providing a lateral flange engaging one side of said cylinder block when said head gasket is properly positioned on said cylinder block.

15. A compressed gas motor comprising a cylinder block assembly providing a central axis and a plurality of peripherally spaced cylinders extending generally radially from said central axis, a crankshaft assembly journaled for rotation about said central axis providing an eccentric crank portion eccentrically movable about said central axis, pistons reciprocable in said cylinders between a top dead center position and a bottom dead center position, and connecting rod means connecting said crank portion and pistons, said cylinder block assembly providing an exhaust port in each cylinder covered by the associated of said pistons except when said associated piston is substantially adjacent to its bottom dead center position, said exhaust port being an inclined peripherally extending slot formed in the wall of each cylinder operable to exhaust gas from cylinders without creating excessive exhaust noise.

16. A compressed gas motor as set forth in claim 15, wherein said exhaust ports open to a circular exhaust manifold chamber providing an enlarged chamber portion adjacent to each exhaust port to dampen exhaust impulses when exhaust ports are opened.

17. A compressed gas motor comprising a cylinder block assembly having cylinders therein having extremities, pistons reciprocable in said cylinders between top dead center positions adjacent to said extremities and bottom dead center positions spaced from said extremities, valved means connected to each cylinder at said extremities thereof, exhaust means including exhaust ports in each cylinder open only when said pistons therein are adjacent to their bottom dead center positions, said valved means operating to supply compressed gas to said extremities of said cylinders having pistons therein commencing to move toward said bottom dead center positions, said valved means also connecting at least some of said cylinders having pistons therein moving toward their top dead center positions to said exhaust means after said exhaust ports are closed by the associated of said pistons.

18. A compressed gas motor as set forth in claim 17, wherein said valved means connects extending pistons to atmosphere without passing therefrom through cylinders having open exhaust ports.

19. A compressed gas motor as set forth in claim 17, wherein said cylinder block assembly includes a plurality of individual cylinders secured along one side to a valve housing, said valve housing providing a radially extending passage means associated with each cylinder and connected with said valve means.

20. A compressed gas motor as set forth in claim 17, wherein said valved means includes a face valve.

21. A compressed gas motor as set forth in claim 17, including a crankshaft rotatable about a central axis and providing an eccentric crank portion, a wrist plate journaled on said crank portion, and a piston rod connecting each piston with said wrist plate, said piston rods being connected to said wrist plate for limited pivotal movement structured to prevent rotation of said wrist plate with said crank portion.

22. A compressed gas motor as set forth in claim 17, wherein said valved means includes a rotating shaft rotatable about an axis, said valved means also including a valved port open to said shaft associated with each cylinder and connecting the extremity thereof, said valved means also including exhaust port means open to said shaft axially spaced along said shaft in one direction from said valved ports and pressure port means open to said shaft and axially spaced along said shaft from the opposite side of said valved ports, said shaft providing connecting portions operable to connect said pressure port to said valved ports associated with cylinders having pistons therein moving from said extended position and to connect said exhaust port means to said valved ports associated with cylinders having pistons therein moving toward said extended position.

23. A compressed gas motor as set forth in claim 18, wherein said valved means contains a passage open to atmosphere.

24. A compressed gas motor as set forth in claim 18, wherein said valved means includes exhaust ports open to atmosphere and said valved means connects said cylinders containing extending cylinders to said exhaust ports in said valved means.

25. A compressed gas motor as set forth in claim 19, wherein said valve housing includes exhaust ports, and said valved means connects said cylinders containing extending pistons to said exhaust ports in said valve housing.

26. A radial fluid pressure device comprising a cylinder block assembly having a central axis and a plurality of radially extending cylinders peripherally spaced around said axis, a piston in each cylinder movable between top dead center and bottom dead center positions, a crankshaft journaled for rotation around said central axis providing an eccentric crank portion, a wrist plate journaled on said crank portion, and a connecting rod pivotally connected to each of said pistons and to said wrist plate, said connection between each connecting rod and said wrist plate permitting limited pivotal movement structured so that said piston rods cooperate to limit rotation of said wrist plate with said crank portion, first lines of action through the pivot axes of said pivotal connections of each of said connecting rods being angled with respect to a second line of action between said central axis and the pivot axis of said piston rods on said pistons when said pistons are in said top dead center and bottom dead center positions.

27. A fluid pressure device as set forth in claim 26, wherein said pistons move between said top dead center and bottom dead center positions along third lines of action angled with respect to said second lines of action in the same direction as said first lines of action.

28. A fluid pressure device as set forth in claim 26, wherein each of said first lines of action is angled with respect to said second line of action so that said first line of action remains on one side of said central axis.

29. A radial fluid pressure device comprising a cylinder block assembly providing a central axis and a plurality of cylinders peripherally spaced around said central axis, a crankshaft journaled for rotation about said central axis providing an eccentric crank portion, a wrist plate journaled on said crank portion, a piston reciprocable in each cylinder, a piston rod connecting each piston to said wrist plate, said piston rods cooperating to prevent rotation of said wrist plate, said pistons being offset with respect to said central axis to increase the effective moment arm of the pistons.

30. A radial fluid pressure device as set forth in claim 29, wherein said pistons are angled with respect to said central axis in the same direction as the offset of their associated piston rods.

* * * * *